US007036920B2

(12) United States Patent
Rousseau et al.

(10) Patent No.: US 7,036,920 B2
(45) Date of Patent: May 2, 2006

(54) FILTERING OF INK DEBRIS IN RECLAIMED LIQUID IN AN IMAGING DEVICE

(75) Inventors: Gerard H. Rousseau, Portland, OR (US); Kelly A. Kessler, Portland, OR (US); Barry D. Reeves, Lake Oswego, OR (US); Timothy L. Crawford, Saint Paul, OR (US)

(73) Assignee: Xerox Corporation, Stamford, CT (US)

( * ) Notice: Subject to any disclaimer, the term of this patent is extended or adjusted under 35 U.S.C. 154(b) by 253 days.

(21) Appl. No.: 10/740,461

(22) Filed: Dec. 22, 2003

(65) Prior Publication Data

US 2005/0134658 A1 Jun. 23, 2005

(51) Int. Cl.
*B41J 2/01* (2006.01)
*B05C 1/00* (2006.01)

(52) U.S. Cl. ..... 347/103; 118/216

(58) Field of Classification Search ..... 347/101, 347/103, 213; 399/237, 239, 248, 249, 274, 399/348, 350; 118/203, 216, 224
See application file for complete search history.

(56) References Cited

U.S. PATENT DOCUMENTS

| | | | | |
|---|---|---|---|---|
| 4,293,866 | A * | 10/1981 | Takita et al. | 347/103 |
| 4,538,156 | A | 8/1985 | Durkee et al. | |
| 5,099,256 | A | 3/1992 | Anderson | |
| 5,389,958 | A | 2/1995 | Bui et al. | |
| 5,805,191 | A | 9/1998 | Jones et al. | 347/103 |
| 5,808,645 | A | 9/1998 | Reeves et al. | |
| 6,068,372 | A | 5/2000 | Rousseau et al. | |
| 6,176,575 | B1 | 1/2001 | Crawford et al. | 347/103 |
| 6,431,703 | B1 * | 8/2002 | Rousseau et al. | 347/103 |

* cited by examiner

*Primary Examiner*—Anh T. N. Vo
(74) *Attorney, Agent, or Firm*—Oliff & Berridge, PLC

(57) ABSTRACT

A system for applying a liquid to a support surface in an imaging apparatus comprises an application surface that applies liquid to the support surface; and a filter positioned in relation t the application surface such that liquid removed from the support surface passes through the filter to the application surface.

21 Claims, 6 Drawing Sheets

FILTERING OF INK DEBRIS IN RECLAIMED LIQUID IN AN IMAGING DEVICE

BACKGROUND OF THE INVENTION

1. Field of Invention

The present invention relates generally to an imaging process. More specifically, the invention relates to an apparatus and method in which a liquid is applied to a support surface, such as an intermediate transfer drum, of the imaging system, and in which liquid removed from the support surface is recycled.

2. Description of Related Art

Ink jet printing systems have utilized intermediate transfer surfaces, such as that disclosed in U.S. Pat. No. 4,538,156 to Durkee et al. This patent discloses a system wherein an intermediate transfer drum is employed with a print head. The surface of the transfer drum may be of a plastic material, such as teflon, tefzel, mylar or the like. In addition, smooth metal or ceramic surfaces can be used. A final receiving surface of paper is brought into contact with the intermediate transfer drum after the image has been placed thereon by the nozzles in the print head. The image is then transferred to the final receiving surface. A cleaning medium is then brought into contact with the intermediate transfer drum to prepare the surface of the drum prior to the next image being formed on the transfer surface.

U.S. Pat. No. 5,099,256 to Anderson describes an intermediate drum with a surface that receives ink droplets from a print head. The intermediate drum surface is thermally conductive and formed from a suitable film-forming silicone polymer allegedly having a high surface energy and high degree of surface roughness to prevent movement of the ink droplets after receipt from the print head nozzles. Anderson teaches that the film-forming silicone polymer coating on the surface of the intermediate drum enables substantially complete transfer of the dehydrated ink droplets therefrom to a recording medium, so that the removal of residual ink from the drum surface by the cleaning means, such as a blade, is unnecessary. The teaching of Anderson, however, does not show how the film-forming silicone polymer is applied to the intermediate drum surface.

U.S. Pat. No. 5,389,958 to Bui et al. discloses an offset ink jet printing system in which a liquid intermediate transfer surface is applied to the transfer drum. Nozzles in the print head then eject drops of ink onto the liquid intermediate transfer surface to form an ink image thereon. A final receiving substrate such as paper is then brought into contact with the intermediate transfer surface, and the ink image is transferred to the final receiving substrate. The liquid intermediate transfer surface is cleaned and reapplied prior to the next image being formed on the transfer surface.

Ink jet printing systems that utilize a liquid intermediate transfer surface generally require an applicator to apply the desired amount of liquid onto the intermediate transfer support surface. An exemplary applicator of this type is disclosed in U.S. Pat. No. 5,808,645 to Reeves et al. (hereinafter "the 645" patent). This patent discloses an applicator that is housed in a replaceable transfer drum maintenance cassette. The applicator uses a wick assembly as a contact medium to concurrently apply the liquid onto the intermediate transfer support surface and to remove foreign matter from the support surface. Specifically, as the support surface or transfer drum rotates, the wick assembly is moved into stationary contact with the rotating transfer drum. In this manner, relative motion is created between the rotating transfer drum and the stationary wick such that the transfer drum brushes or rubs against the wick. This allows the wick to contact and remove foreign matter and debris from the drum. However, it also allows debris to accumulate at the point of contact between the drum and the wick, which can interfere with the application of liquid to the drum. This applicator assembly also includes a hydrodynamic wiper blade that uniformly meters and distributes the liquid intermediate transfer surface over the transfer drum.

In the 645 patent, a supply of liquid for the wick is maintained in two separate oil filled bladders adjacent to the applicator assembly. The release of the oil from the oil bladders is actuated by the movement of the wick assembly upwardly along a valve opening track as the wick assembly moves toward the transfer drum support surface. This movement opens a valving system that allows oil to flow from the bladders through oil access cross bores and spool valve bodies and into a channel that contains the wick. From the channel the oil is wicked upwardly to the upper portion of the wick that contacts the transfer drum.

In the 645 patent, prior to installation of the drum maintenance cassette in a printer, the wick is dry, the valving system is closed and the oil does not flow from the bladders to the wick. Upon insertion of the cassette into a printer, the valving system is opened as described above and the oil begins flowing to the wick. To allow the wick to become sufficiently saturated with the oil for proper operation, printing is disabled for a predetermined period, designated the "time-to-first-print," after a new cassette is inserted in a printer.

U.S. Pat. No. 6,068,372 to Rousseau et al. (hereinafter "the 372 patent") also discloses a replaceable liquid application system for applying a liquid intermediate transfer surface to a support surface in a printer. The liquid application system is contained in a removable cassette and utilizes a liquid impregnated arcuate surface that engages the support surface by rolling contact. The liquid impregnated arcuate surface is contained in a removable cartridge in the cassette. A cartridge life status assembly determines when the useful life of the cartridge has been exhausted. Push tabs on the cartridge and finger wells on the cassette allow for easy and convenient removal of a used cartridge and insertion of a replacement cartridge.

In the 372 patent, the cartridge also contains a reclamation assembly that extends the useful life of the cartridge. The reclamation assembly reclaims liquid from the support surface, filters the liquid by passing the liquid over a filter and supplies the liquid back to the arcuate surface for reapplication to the support surface. Over time, however, the filter is clogged with debris. Once it becomes too clogged the system will operate as if the filter did not exist, thus allowing debris to clog the roller.

SUMMARY OF THE INVENTION

The present invention is directed to a system for applying a liquid to a support surface in an imaging apparatus. This support surface may be the surface of an intermediate transfer drum. The system comprises an application surface that applies liquid to the support surface and a filter positioned in relation to the application surface such that liquid removed from the support surface passes through the filter to the application surface. By passing the liquid through the filter rather than along one side of the filter, as described in the 372 patent, a greater surface area of the filter may be utilized by the filtration process increasing the useful life of the system.

In embodiments of the invention, the application surface is the surface of a roller that is in rolling contact with the support surface. In addition, in embodiments of the invention, the roller is impregnated with the liquid. As the liquid impregnated roller moves past the support surface through rolling contact, liquid impregnated in the roller is transferred to the support surface providing an intermediate liquid transfer surface on the support surface.

In embodiments of the invention, the roller is formed of an absorbent material, particularly a polyurethane foam and more preferably a polyurethane foam having an oil retention capacity of at least 60% of its total volume.

In embodiments of the invention, the filter is a porous, open-cell filter. The capillary property of such a filter drives oil through the filter to the application surface, leaving any solid particles, such as ink or paper dust, trapped in the filter. In embodiments of the invention, the filter is formed of a non-woven textile, preferably a polyester felt.

In embodiments of the invention, the intermediate liquid transfer surface comprises at least one liquid selected from the group consisting of water, fluorinated oil, glycol, mineral oil, silicone oil, a surfactant, a functional oil, or a combination thereof. In a preferred embodiment, the liquid comprises silicone oil.

In embodiments of the invention, the application surface and filter are in a cartridge that can be removed and replaced to increase the useful life of the imaging device.

In embodiments of the invention, the system further comprises a metering blade for distributing the liquid on the support surface. In the process of distributing liquid on the support surface, some liquid from the support surface may be removed from the support surface. In preferred embodiments of the invention, this liquid then passes through the filter to the application surface in order to be reused.

In embodiments of the invention in which the system includes a metering blade, the metering blade may, but need not, be in a cartridge that also contains an application surface and a filter. The metering blade may be attached to such a cartridge or to another part of the imaging device by an elongated blade mounting bracket. The blade mounting bracket may include downwardly directed drip points for communicating liquid removed from the support surface by the metering blade to the filter.

In embodiments of the invention, there may be a physical barrier adjacent the application surface that directs liquid removed from the support surface to the filter. This physical barrier blocks the ability of the liquid removed from the support surface by, for example, the metering blade, from coming into contact with the application surface before it goes through the filter. This physical barrier may also provide structural support for the filter. In particular, the filter may be attached to this physical barrier.

The present invention is also directed to an imaging device comprising the liquid application system described above. Specifically, the present invention is directed to an imaging device comprising a support surface, an application surface that applies liquid to the support surface to form an intermediate liquid transfer surface on the support surface, a filter positioned in relation to the application surface such that liquid removed from the support surface passes through the filter to the application surface, and a printhead that applies ink on the intermediate liquid transfer surface on the support surface. In embodiments, this imaging device is a phase change ink jet printer. In addition, in embodiments, the support surface of this imaging device is the surface of a transfer drum rotatably mounted in the imaging device.

The present invention is also directed to a method for applying liquid to a support surface in an imaging device. The method of the present invention comprises bringing an application surface into contact with the support surface to apply liquid from the application surface to the support surface; metering the liquid on the support surface, thereby removing liquid from the support surface; and passing liquid removed from the support surface through a filter to the application surface for reapplication to the support surface.

These and other features and advantages of this invention are described in, or are apparent from, the following detailed description of various exemplary embodiments of the system and methods according to the invention.

BRIEF DESCRIPTION OF THE DRAWINGS

Various exemplary embodiments of the systems and methods of this invention are described in detail below, with reference to the attached drawing figures, in which.

DETAILED DESCRIPTION OF EXEMPLARY EMBODIMENTS

Reference will now be made in detail to an exemplary embodiment of the invention as illustrated in the accompanying drawings. In this exemplary embodiment, the ink printing apparatus is a phase change ink printing apparatus.

Figure 1:
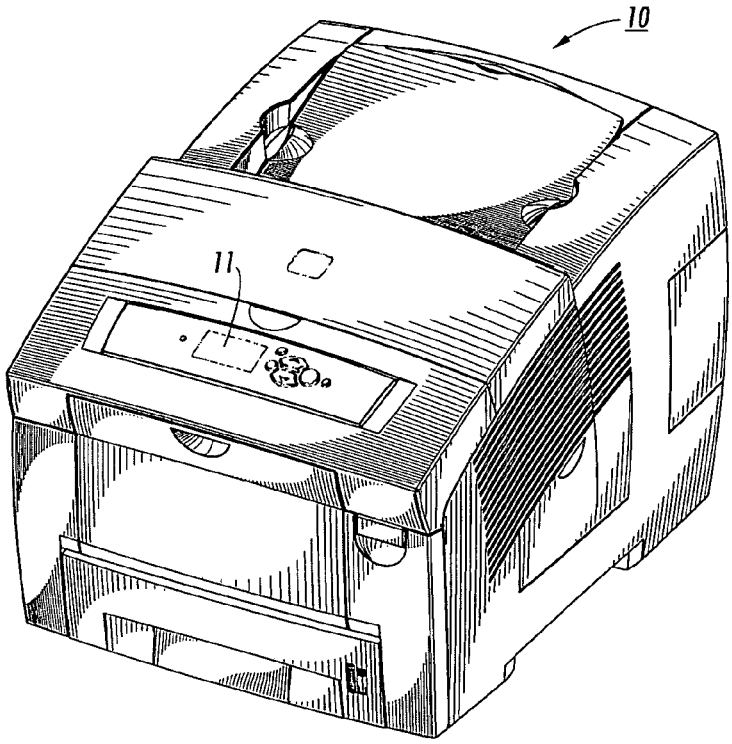
FIG. 1 is an overall perspective view of an exemplary phase change ink offset printer that utilizes the liquid application system of the present invention.

FIG. 1 is an overall illustration of a phase change ink printing apparatus, generally indicated by the reference numeral 10, which utilizes the liquid application system of the present invention. As referenced above, the liquid application system of the present invention may be utilized to apply a liquid intermediate transfer surface to an intermediate transfer support surface in an offset printing apparatus. Examples of solid ink or phase change ink offset imaging technology is disclosed in U.S. Pat. No. 5,389,958 to Bui et al., U.S. Pat. No. 5,808,645 to Reeves et al. and U.S. Pat. No. 6,068,372 to Rousseau et al., each of which are hereby specifically incorporated by reference in their entirety.

The following description of an exemplary embodiment of the liquid application system of the present invention refers to its use in the type of phase change ink offset printing apparatus described in these three patents. It will be appreciated, however, that the present application system may be used with various other imaging and printing apparatus that utilize different imaging technologies and/or architectures and require the application of a liquid. Accordingly, the following description will be regarded as merely illustrative of one embodiment of the present invention.

Figure 2:
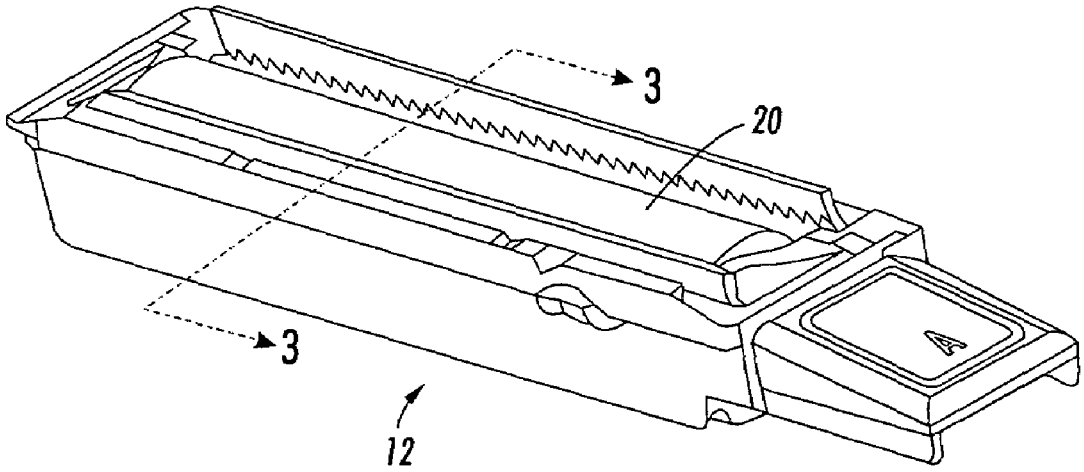
FIG. 2 is a perspective view of an exemplary replaceable cartridge that is inserted into the printer of FIG. 1 and may contain the liquid application system of the present invention.

FIG. 2 illustrates a replaceable cartridge 12 that utilizes a liquid application system of the present invention to apply a liquid intermediate transfer surface to a support surface in an offset inkjet printer. The removable cartridge, which may be referred to as a drum maintenance unit, contains a liquid impregnated roller 20 for applying the intermediate liquid transfer surface to the support surface in the printer 10. The replaceable cartridge may be connected to the printer as described in U.S. Patent Application Publication No. 2005/0134666, to Rousseau, which is herein incorporated by reference in its entirety. Preferably, the cartridge 12 is made from a low-cost structural material, such as plastic.

Figure 3:
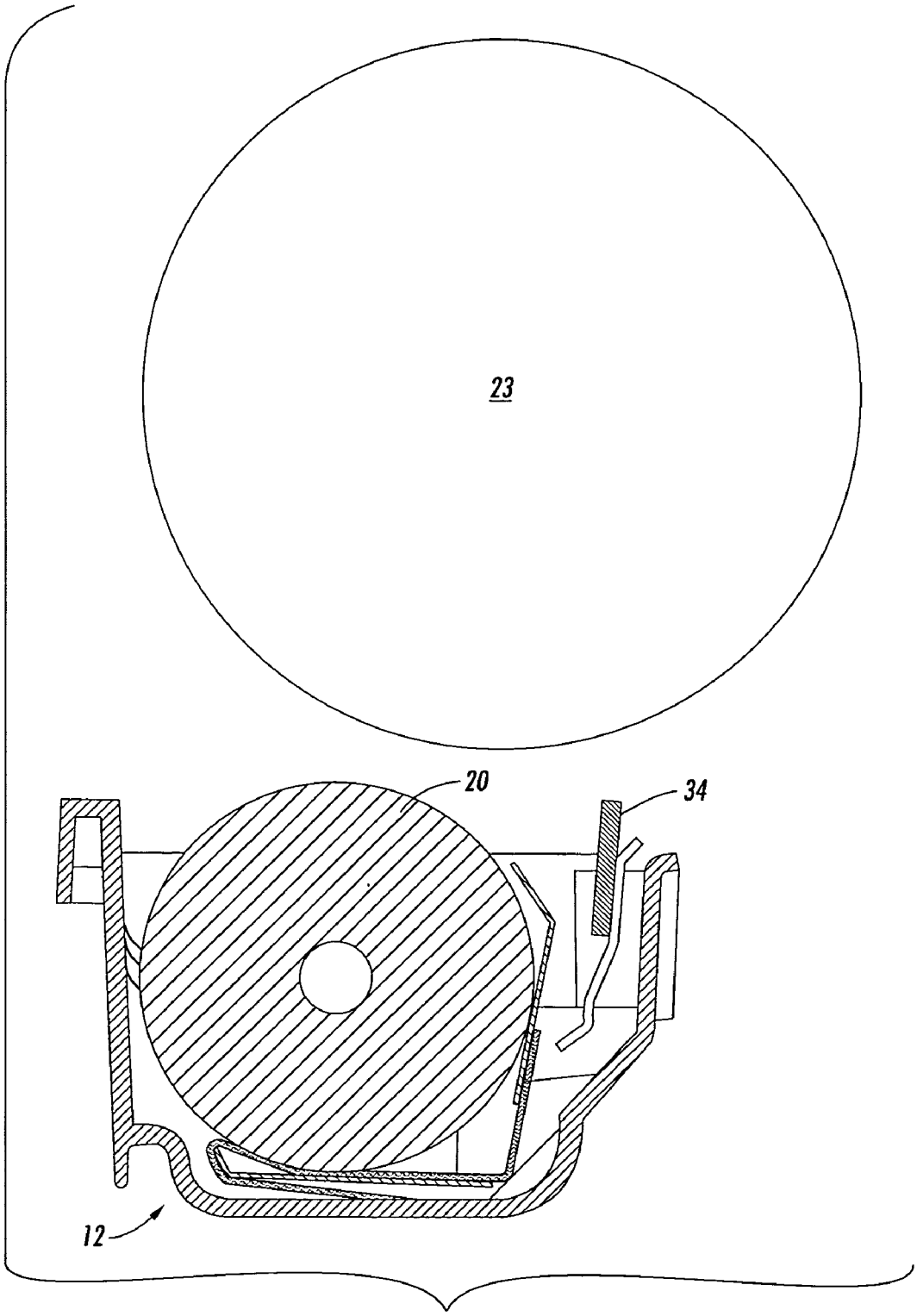
FIG. 3 is a side view of the cartridge taken along the section line 3—3 in FIG. 2 showing an exemplary embodiment of a liquid application system of the present invention in a park position adjacent to the transfer drum in the printer.

FIG. 3 illustrates a sectional side view of an exemplary replaceable cartridge 12 of the present invention in a first, "park" position. The cartridge 12 is shown positioned adjacent to the intermediate transfer support surface in the printer. The intermediate transfer support surface may take the form of a transfer drum 23 as shown in FIG. 3, or alternatively may be a belt, web, plate or other suitable design. The removable cartridge is generally indicated by the reference numeral 12 and includes a liquid impregnated roller 20. In the "park" position illustrated in FIG. 3, the liquid impregnated roller 20 and the blade 34 are not in contact with the transfer drum 23.

Figure 4:
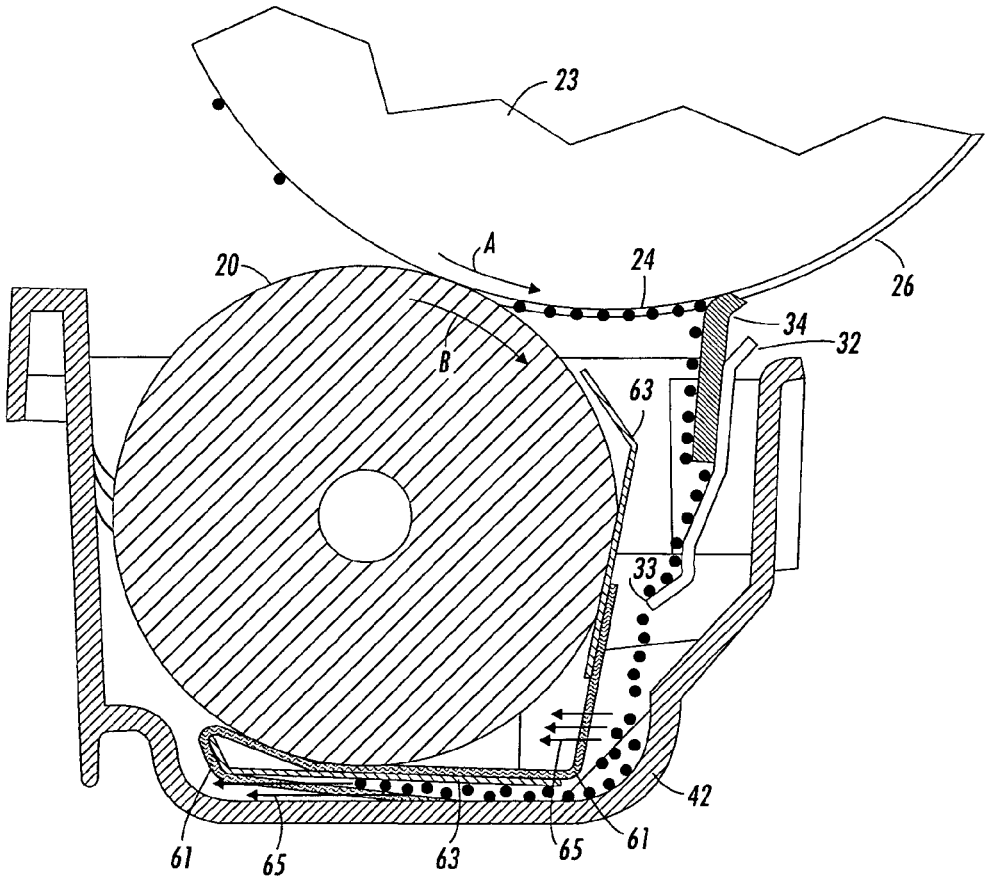
FIG. 4 is an enlarged partial side view showing an exemplary embodiment of liquid application system of the present invention in which the roller and blade are elevated to an apply position in which the roller and blade engage the transfer drum and apply a liquid intermediate transfer surface to the drum.

With reference to FIG. 4, prior to imaging, the liquid impregnated roller 20 is raised to contact and apply a liquid intermediate transfer surface 26 to the surface 24 of the transfer drum 23. In embodiments, the roller 20 is formed from an absorbent material, such as extruded polyurethane foam. The polyurethane foam preferably has an oil retention capacity (volume of oil/volume of foam) of at least 60 percent, and most preferably 70 percent, and a capillary height of at least nine inches. The roller 20 may have an outer diameter of 1.75 inches (44.45 mm), a length of 8.24 inches (209.3 mm) and is mounted on a shaft 30 having a diameter of 0.375 inches (9.53 mm). Advantageously, by forming the roller 20 from a material having a capillary height that is greater than the length of the roller, it is assured that a fully saturated roller will not leak or drip, regardless of orientation.

With continued reference to FIG. 4, the cartridge 12 also includes a metering blade 34 that distributes the liquid intermediate transfer surface 26 across the surface 24 of the transfer drum 23 to consistently provide a uniform liquid layer on the drum surface. In embodiments, the blade 34 is comprised of an elastomeric material and is affixed to an elongated blade mounting bracket 32. As described above, the function of the liquid impregnated roller 20 and the elastomeric blade 34 is to apply a finely metered amount of liquid to the transfer drum surface 24.

In operation, the transfer drum 23 rotates in the direction of action arrow A as the liquid impregnated roller 20 and blade 34 are raised into contact with the transfer drum surface 24. The roller 20 is driven to rotate in the direction of action arrow B by frictional contact with the transfer drum surface 24 and applies the liquid intermediate transfer surface 26 to the drum surface 24. Advantageously, as the roller 20 rotates as it applies liquid to the drum surface 24, the point of contact on the roller 20 is continuously moving such that a fresh portion of the roller 20 is continuously contacting the drum surface to apply the liquid. As the liquid intermediate transfer surface 26 on the drum surface 24 reaches the blade 34, the blade 34 then meters the liquid to evenly distribute a uniform liquid layer across the drum surface 24.

Once the application of the liquid intermediate transfer surface 26 is complete, the print head (not shown) jets an ink image on top of this liquid surface. The ink image is then transferred and fused onto a final receiving medium, such as paper, by pressing the paper against the transfer drum 23 with a rotating pressure roller (not shown). The liquid intermediate transfer surface 26 acts as a sacrificial layer which can be at least partially transferred with the ink image to the final receiving medium. Suitable liquids that may be used as the liquid intermediate transfer surface 26 include water, fluorinated oils, glycol, surfactants, mineral oil, silicone oil, functional oils and combinations thereof. Functional oils can include, but are not limited to, mercapto-silicone oils, fluorinated silicone oils and the like. The liquid may be silicone oil, particularly amino silicone oil. The final print medium may be a transparency, paper or other suitable media.

With continued reference to FIG. 4, the blade 34 functions to meter the correct amount of oil onto the drum surface 24 and to capture paper fibers, untransfixed pixels and other debris. The oil impregnated roller 20 applies enough oil to the drum surface 24 to maintain a constant puddle or "oil bar" in front of the blade 34 to insure that there is always a sufficient amount of oil available to be metered. In operation, the debris captured by the blade 34 becomes trapped in the oil bar and flows down the blade as described in more detail below. As the blade 34 meters the oil, the blade is lifted off the drum surface 24 to allow a metered portion of the oil to flow past the blade. By adjusting the contact force of the blade 34 against the drum surface 24 and the angle of attack of the blade, the desired amount of blade lift is established.

Figure 5:
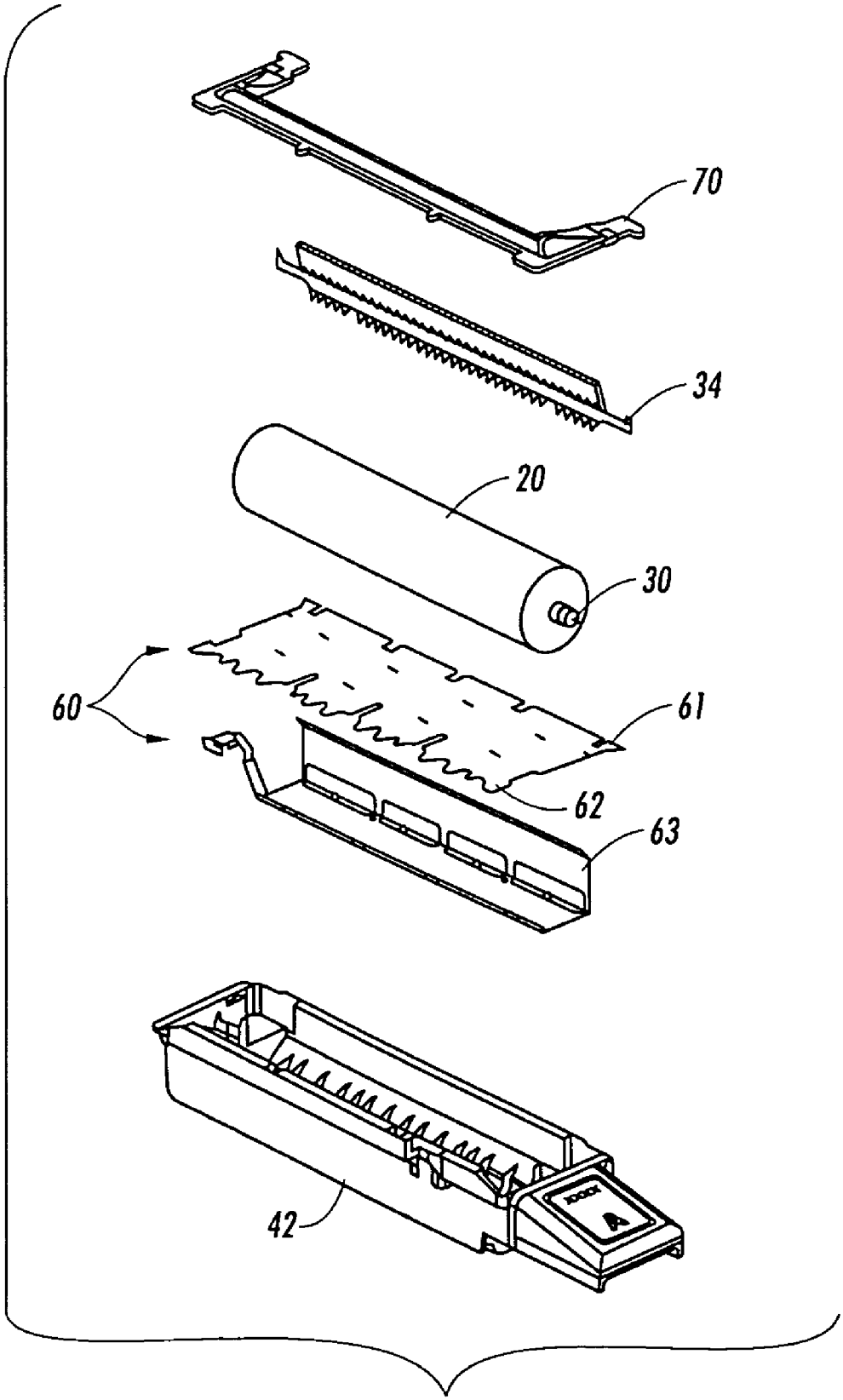
FIG. 5 is an exploded perspective view of the replaceable cartridge of FIG. 2, showing both the filter and the support of the exemplary reclamation assembly.

FIG. 5 is an exploded perspective view of the removable cartridge 12 in FIG. 2. As shown in FIG. 5, the removable cartridge 12 comprises an elongated housing 42. A shaft 30 extends from each end of the roller 20 and into apertures in the housing (not shown). In an embodiment of the invention described in U.S. patent application Publication No. 2005/0134632, to Rousseau, which is herein incorporated by reference in its entirety, the shaft 30 is inserted into caps that fit in the apertures. In this manner, the roller 20 is rotatably retained within the housing 42. The removable cartridge 12 may further include a cover 70.

As in the embodiment depicted in FIG. 5, the removable cartridge 12 may further include a metering blade 34. The metering blade 34 may, but need not, be in the cartridge as described in U.S. Pat. No. 6,921,064, to Rousseau, which is herein incorporated by reference in its entirety. However, in other embodiments, such the system described in U.S. Pat. No. 6,068,372 to Rousseau et al., which is also herein incorporated by reference in its entirety, the metering blade need not be in the cartridge.

Figure 6:
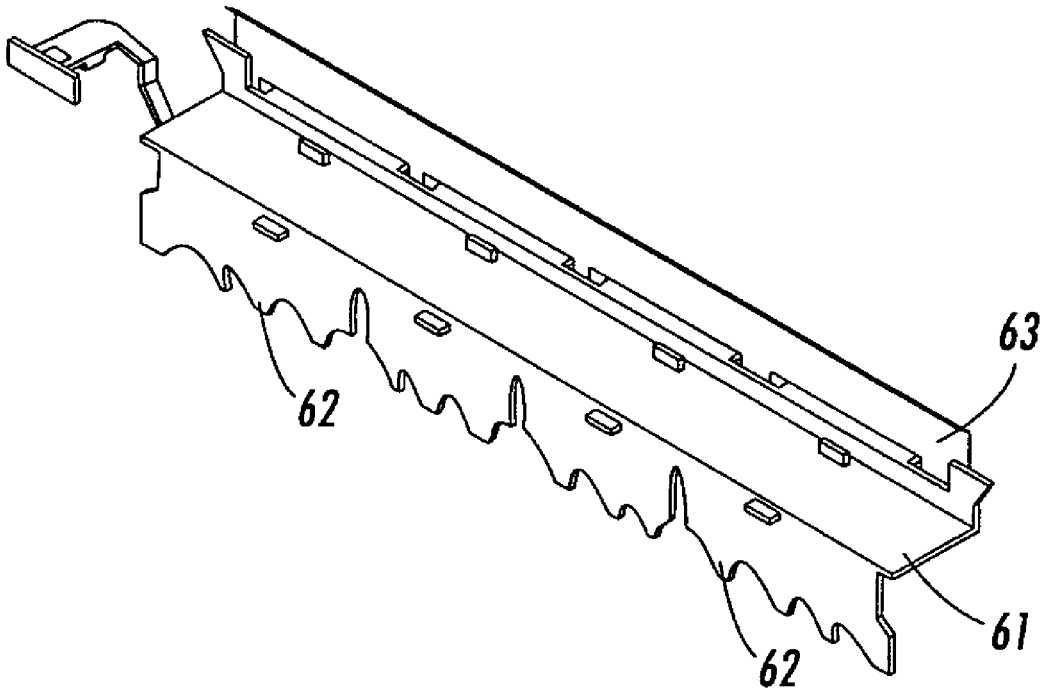
FIG. 6 is an enlarged perspective view of the filter and the support of the exemplary reclamation assembly, as fit together.

With reference to FIGS. 5 and 6, the exemplary removable cartridge 12 also includes a reclamation assembly, generally designated by the reference numeral 60, that recycles reclaimed oil from the drum surface 24, filters debris from the oil and transfers the reclaimed oil to the roller 20 for reapplication to the drum surface. In embodiments, the reclamation assembly 60 includes a filter 61, which may be formed of a synthetic non-woven textile, such as a polyester felt. The filter may include articulated liquid receiving elements 62 that conform to the interior of the housing 42. In embodiments, the reclamation assembly further includes a support 63 that holds the filter into position. The support may be formed of any material that is impermeable to the liquid and provides sufficient structure to maintain the position of the filter. The support 63 may also provide a physical barrier between reclaimed liquid and the roller 20 before it is filtered. Further description of a particular support that may be used in the present invention is provided in U.S. patent application Publication No. 2005/0134630 , to Rousseau, which is herein incorporated by reference in its entirety. As depicted in FIG. 6, the filter 61 fits through holes in the support 63. In addition, the liquid receiving elements 62, which conform to the interior of the housing 42, may be folded beneath the support 63.

With reference to FIG. 4, in operation, excess oil from the liquid intermediate transfer surface 26 and debris trapped within the oil, such as paper fibers, untransfixed ink pixels and the like, flow down the blade 34 and blade mounting bracket 32 and drip onto the filter 61. The blade mounting bracket 32 may include multiple downwardly directed drip points 33 from which the excess oil and entrained debris drip. The drip points 33 extend across the length of the mounting bracket 32 to evenly distribute the excess oil to the filter 61.

As the excess or reclaimed oil and entrained debris drips onto the filter, it begins to flow though the filter 61. As the oil flows through the filter 61, the polyester fibers thereof filter the oil by trapping and retaining debris while simultaneously allowing the oil to flow though the filter to the other side of the filter where it comes into contact with the roller 20. The oil has two paths, which are each depicted by a set of arrows 65 in FIG. 4. In this manner, the reclaimed oil that is transferred back to the roller 20 has been filtered to remove the debris captured by the blade 34 and the filtered debris accumulates in the filter 61 away from contact with the roller 20. Additionally, by recycling the reclaimed oil back into the roller 20, the reclamation assembly significantly increases the useable life of the roller 20 and thus the removable cartridge 12.

To alert an operator that the cartridge 12 should be replaced, a life status assembly (not shown) may be utilized to determine the end of the useful life of the cartridge. The life status assembly may be in the cartridge 12 or in another part of the imaging device. In embodiments, the life status is managed by an electronic EEPROM single wire device (SWD) located onboard the cartridge. The SWD, which contains a circuit board, is electrically connected to the printer 10 when the cartridge 12 is fully inserted in the printer and includes an internal counter that is decremented as prints are made. When the counter in the circuit board reaches a predetermined value that is calculated to correspond to a low oil condition in the oil-impregnated roller 20, the printer 10 generates a message on the display panel 11 (see FIG. 1) that advises the operator to replace the cartridge 12. The useful life of the cartridge 12 varies depending on the amount of oil loaded in the roller 20 and the type of cartridge. The useful life may be between 10,000 and 30,000 prints before replacement is necessary. When a cartridge 12 is replaced, a new life status assembly may also be provided. The life status assembly may also store additional cartridge life status data and related information.

The foregoing description of an exemplary embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, other than solid ink offset printer, all without departing from the inventive concepts disclosed herein.

What is claimed is:

1. A system for applying a liquid to a support surface in an imaging apparatus, the system comprising:

an application surface that applies liquid to the support surface;

a blade structure configured to remove liquid from the support surface; and a filter positioned between the application surface and the blade structure such that substantially all liquid removed from the support surface by the blade structure must pass through the filter to reach the application surface.

2. The system of claim 1, wherein the filter is formed of a non-woven textile.

3. The system of claim 2, wherein the non-woven textile is a polyester felt.

4. The system of claim 1, wherein the support surface is a surface of an intermediate transfer drum.

5. The system of claim 1, wherein the liquid forms an intermediate liquid transfer surface on the support surface.

6. The system of claim 5, wherein the intermediate liquid transfer surface is comprised of a liquid selected from the group consisting of water, fluorinated oil, glycol, mineral oil, silicone oil, a surfactant, a functional oil, or a combination thereof.

7. The system of claim 6, wherein the intermediate liquid transfer surface is comprised of silicone oil.

8. The system of claim 1, wherein the blade structure comprises a metering blade configured to distribute the liquid on the support surface.

9. The system of claim 1, wherein the blade structure comprises a blade and an elongated blade mounting bracket to which the blade is attached, the blade mounting bracket including downwardly directed drip points for communicating liquid removed from the support surface to the filter, the filter being positioned at least between the dip points and the application surface.

10. The system of claim 1, further comprising a physical barrier positioned between the application surface and the blade structure such that substantially all liquid removed from the support surface by the blade structure must pass through the filter to reach the application surface.

11. The system of claim 10, wherein the physical barrier provides structural support for the filter.

12. The system of claim 1, wherein the system is housed in a cartridge configured to be removed from the imaging device and replaced with another cartridge.

13. The system of claim 12, wherein the cartridge further comprises a metering blade for distributing the liquid on the support surface, wherein the metering blade removes liquid from the support surface, which passes through the filter to the application surface.

14. The system of claim 12, wherein the cartridge further comprises a life status assembly that determines an end of useful life of the cartridge.

15. An imaging device comprising:

a support surface;

an application surface that applies liquid to the support surface to form an intermediate liquid transfer surface on the support surface;

a blade structure configured to remove liquid from the support surface;

a filter positioned between the application surface and the blade structure such that substantially all liquid removed from the support surface by the blade structure must pass through the filter to reach the application surface; and a print head that applies ink onto the intermediate liquid transfer surface on the support surface.

16. The imaging device of claim 15, wherein the blade structure comprises a metering blade configured to distribute the intermediate liquid transfer surface on the support surface.

17. The imaging device of claim 15, wherein the imaging device is a phase change ink jet printer.

18. The imaging device of claim 15, wherein the support surface is a surface of a transfer drum rotatably mounted in the imaging device.

19. A method for applying a liquid to a support surface in an imaging device, said method comprising:

bringing an application surface into contact with the support surface to apply liquid from the application surface to the support surface;

metering the liquid on the support surface, thereby removing liquid from the support surface;

passing liquid removed from the support surface through a filter to the application surface for reapplication to the support surface; and preventing substantially all removed liquid from reaching the application surface without passing through the filter.

20. A method according to claim 19, wherein metering the liquid is accomplished by a blade structure and wherein substantially preventing removed liquid from reaching the application surface without passing through the filter comprises positioning the filter between the application surface and the blade structure.

21. A method according to claim 19, wherein metering the liquid is accomplished by a blade structure and wherein substantially preventing removed liquid from reaching the application surface without passing through the filter comprises positioning a physical barrier between the application surface and the blade structure.

* * * * *